US009140270B2

(12) United States Patent
Hong

(10) Patent No.: US 9,140,270 B2
(45) Date of Patent: Sep. 22, 2015

(54) CENTRIFUGAL FAN ASSEMBLY

(75) Inventor: Tao Hong, Farmington Hills, MI (US)

(73) Assignee: Brose Fahrzeugteile GmbH & Co. Kommanditgesellschaft, Würzburg, Würzburg (DE)

( * ) Notice: Subject to any disclaimer, the term of this patent is extended or adjusted under 35 U.S.C. 154(b) by 443 days.

(21) Appl. No.: 13/231,993

(22) Filed: Sep. 14, 2011

(65) Prior Publication Data

US 2013/0064660 A1 Mar. 14, 2013

(51) Int. Cl.
*F04D 29/28* (2006.01)
*F04D 17/02* (2006.01)
*F04D 29/42* (2006.01)

(52) U.S. Cl.
CPC ..... *F04D 29/282* (2013.01); *F04D 17/025* (2013.01); *F04D 29/4226* (2013.01)

(58) Field of Classification Search
CPC ..... F04D 29/28; F04D 29/281; F04D 29/282; F04D 29/283; F04D 29/30; F04D 17/16
USPC ..... 416/178, 187, 223 B, 182, 181, 179, 416/214 R, 191; 29/889.4
See application file for complete search history.

(56) References Cited

U.S. PATENT DOCUMENTS

| | | | | |
|---|---|---|---|---|
| 3,704,828 | A * | 12/1972 | Studer et al. | 239/265.19 |
| 4,383,801 | A * | 5/1983 | Pryor | 416/17 |
| 4,521,154 | A * | 6/1985 | Corbett | 416/175 |
| 5,707,209 | A * | 1/1998 | Iyer et al. | 416/186 R |
| 5,951,245 | A * | 9/1999 | Sullivan | 415/192 |
| 5,951,249 | A | 9/1999 | Aylor | |
| 6,092,988 | A * | 7/2000 | Botros | 415/191 |
| 7,585,154 | B2 * | 9/2009 | Lan et al. | 416/175 |
| 7,758,305 | B2 * | 7/2010 | Kurszewski et al. | 415/205 |
| 2005/0095133 | A1 * | 5/2005 | O'Connor | 416/187 |
| 2005/0265832 | A1 | 12/2005 | Horng et al. | |
| 2009/0104024 | A1 | 4/2009 | Kay | |

FOREIGN PATENT DOCUMENTS

| | | | |
|---|---|---|---|
| DE | 2364921 | | 7/1974 |
| DE | 102004022964 | A1 | 6/2005 |
| DE | 102008000168 | A1 | 9/2008 |
| DE | 202008017021 | U1 | 4/2009 |
| DE | 102008051362 | A1 | 4/2010 |

OTHER PUBLICATIONS

Clarage; Fan Engineering; 2000, Twin City Fan Companies, Ltd.*
Search Report in DE 102012216288.7 dated Apr. 5, 2013.

* cited by examiner

*Primary Examiner* — Nathaniel Wiehe
*Assistant Examiner* — Michael Sehn
(74) *Attorney, Agent, or Firm* — Manelli Selter PLLC; Edward J. Stemberger

(57) ABSTRACT

The present invention relates to a centrifugal fan assembly and a HVAC-system, comprising a housing, a blower wheel comprising a plurality of fan blades, the blower wheel being rotatably mounted in the housing and constructed to generate an airflow flowing axially into the blower wheel and radially out from the blower wheel, a guiding vane device including a plurality of guiding vanes, the guiding vane device being coupled to the blower wheel and configured to guide the airflow into the blower wheel.

12 Claims, 6 Drawing Sheets

CENTRIFUGAL FAN ASSEMBLY

The present invention relates generally to an HVAC-System. More particularly, the present invention relates to a centrifugal fan assembly for automotive vehicles.

BACKGROUND OF THE INVENTION

Centrifugal fan assemblies generally include a blower wheel that is arranged in a housing and which may be driven by an electric motor. The blower wheel has curved blade fans which draw air in axially, along the axis of rotation of the blower wheels, and discharge air radially outwardly. Such fan assemblies are used in a variety of applications, such as in automotive applications.

In automotive applications it is always an object to minimize the generation of noise, to make the driving of the automotive vehicle as convenient as possible. Furthermore, low noise generation increases the safety of the passengers in the vehicle, because low noise increases the attention of the driver.

The noise of a centrifugal fan assembly is produced mainly by the rotating parts of the centrifugal fan assembly, especially by the blower wheel. Airflow gets into the blower wheel from its top without any rotational motion, then flows into the blade region and is suddenly accelerated to the rotational speed of the blower wheel. This sudden increase of rotational speed results in a separation of the airflow at the leading edge of the fan blades of the blower wheel. This separation results in increased noise, vibration, and harshness as well as in degrading the efficiency of the centrifugal fan.

Another requirement in automotive applications is to minimize the size of the blower for a given flow requirement, or maximize airflow output for a given blower volume. The separation of the airflow also reduces the volume efficiency of the blower unit.

Many attempts have been made to reduce the separation of the airflow at the leading edge of the fan blades, the noise generation, vibration, harshness of a centrifugal fan assembly, and to increase its airflow output for a given volume.

U.S. Pat. No. 5,951,249 A1 discloses a centrifugal fan assembly for an automotive vehicle. The centrifugal fan assembly includes a blower wheel driven by an electric drive and a stationary device which imparts a predetermined amount of spin to a volume of air as the air enters the centrifugal fan assembly. The stationary device is disposed axially with respect to the axis of rotation of the blower wheel and is secured thereto so as not to include any moving parts.

U.S. Pat. No. 5,951,245 discloses a centrifugal blower assembly. The blower assembly includes a centrifugal fan driven by an electric motor and a stationary device which imparts a predetermined amount of spin to a volume of air as the air enters the centrifugal blower assembly. The device is disposed axially with respect to the axis of rotation of the fan and is secured thereto so as not to include any moving parts.

This centrifugal fan assembly reduces the noise generation of the centrifugal fan assembly. However, this centrifugal fan assembly is ineffective since the stationary device cannot create enough rotating velocity in incoming airflow.

BRIEF SUMMARY OF THE INVENTION

Therefore, it is an object of the invention to provide a more effective and less complicated centrifugal fan assembly which reduces the flow separation and improves the fan's efficiency.

Accordingly, the present disclosure provides for a centrifugal fan assembly comprising a housing, a blower wheel comprising a plurality of fan blades, wherein the rotational blower wheel is mounted in the housing and constructed to generate an airflow flowing axially into the blower wheel and radially out from the blower wheel, a guiding vane device including a plurality of guiding vanes, wherein the guiding vane device is coupled to the blower wheel and is configured to guide the airflow into the blower wheel.

The present invention also provides for a HVAC-System comprising:

a housing, a centrifugal fan, a blower wheel comprising a plurality of fan blades, wherein the blower wheel is rotatably mounted in the housing and constructed to generate an airflow flowing axially into the blower wheel and radially out from the blower wheel, a guiding vane device including a plurality of guiding vanes, wherein the guiding vane device is coupled to the blower wheel and is configured to guide the airflow into the blower wheel.

The present invention provides a centrifugal fan assembly with a guiding vane device which comprises a plurality of guiding vanes and rotates with the blower wheel. The guiding vane device guides incoming air flow into the blower wheel and gradually increases the rotating speed of the airflow as it goes down the guiding vanes. The guiding vane device is capable of gradually accelerating incoming non-rotating airflow to the rotating speed of the blower wheel.

Due to this configuration, the acceleration of the airflow is done smoothly, and therefore the flow separation at the leading edge of the blow fan blades is eliminated. With the present invention, the blower fan assembly operates more efficiently while at the same time reducing the generation of noise.

The present invention provides for a centrifugal fan assembly with significantly more airflow for the same size and significantly lower operating speed for the same airflow rate than known fan assemblies. Furthermore, the provided centrifugal fan assembly is quieter in comparison to known centrifugal fan assemblies.

In an embodiment of the present invention, the guiding vane device is arranged at an axial end face of the blower wheel. For example the guiding vane device covers the complete end face of the blower wheel. However, it is also possible that the guiding vane device covers only a portion of the end face of the blower wheel. In another embodiment, the blower wheel assembly comprises two guiding vane devices, one on each end face side of the blower wheel respectively.

In another embodiment of the present invention, at least one of the guiding vanes comprises a curved leading edge. The curved leading edge of the blower wheel fans increases the performance of the guiding vane device. In a preferred embodiment of the invention, all the guiding vanes comprise a curved leading edge.

In yet another embodiment of the present invention at least one guiding vane comprises a setting device, and an angle of the curved leading edge is adjustable during operation by means of the setting device. Due to this configuration, the blower wheel can be optimized and adapted to different rotating speeds during operation. The setting device may be for example electro-magnetic.

In a further embodiment of the present invention the guiding vane device is formed integrally with the blower wheel as a single part. The guiding vane is optimized for the designed maximum operating speed of the blower wheel. This configuration reduces the costs for manufacturing the centrifugal fan assembly. Furthermore, the stability of the guiding vanes device and the blower wheel is increased.

In another embodiment of the present invention the blower wheel comprises fan blades that are curved-forward, that are backward-curved or they are straight radial. The blower wheel can be adapted and used to various conditions and applications.

In yet another embodiment of the present invention the guiding blade device comprises guiding vanes, which are forward-curved vanes, backward-curved vanes or straight radial vanes. A combination of forward-curved vanes, backward-curved vanes and straight radial vanes is comprised in the present invention. The guiding vane device can be adapted to various conditions and can be used in different applications.

The blower wheel is driven by one of a direct drive, a belt drive, a magnetic coupling and a hydraulic coupling. Other drive mechanisms are also possible.

In another embodiment of the invention the number of fan blades differs from the number of guiding vanes.

The number of guiding vanes is equal to half of the number of fan blades.

In yet another embodiment of the invention the blower wheel is an injection molded plastic part. For example, the blower wheel is made at least partially of a thermoplastic material or a thermosetting polymer material.

In another embodiment of the invention the guiding vane device is an injection molded plastic part. Also the guiding vane device can be made of a thermoplastic material or a thermosetting polymer material.

The housing of the centrifugal fan assembly is also an injection moulded plastic part. However, the blower wheel, the guiding vane device and the housing can comprise a metallic material or a composite material.

BRIEF DESCRIPTION OF THE SEVERAL VIEWS OF THE DRAWINGS

The above-mentioned and other features and advantages of this disclosure will become more apparent and the disclosure itself will be better understood by reference to the following description of embodiments of the disclosure taken in conjunction with the accompanying drawings, wherein.

The following description is merely exemplary in nature and is not intended to limit the present disclosure, application, or its uses. It should be understood that throughout the drawings, identical reference numerals indicate the same or corresponding parts and features.

DETAILED DESCRIPTION OF THE INVENTION

Figure 1:
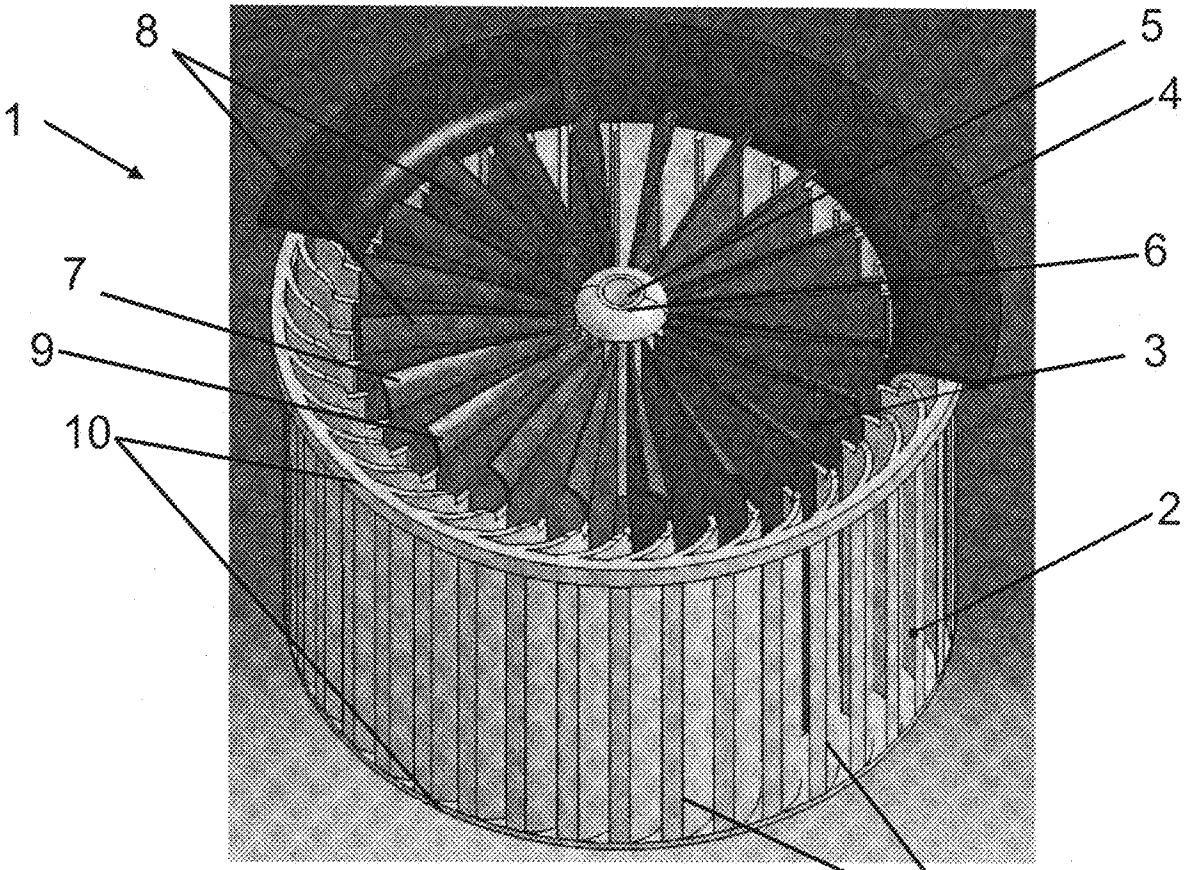
FIG. 1 is a perspective view of a centrifugal fan assembly for an automotive vehicle according to the present invention.

FIG. 1 is a perspective view of a centrifugal fan assembly 1 for an automotive vehicle according to the present invention. The centrifugal fan assembly 1 comprises a housing 4 and a blower wheel 2 including a first number of fan blades 7. The blower wheel 2 is rotatably mounted within the housing 4 and may be driven by an electric drive, a direct drive, a belt drive, a magnetic coupling or a hydraulic coupling (not shown).

The fan blades 7 of the blower wheel 2 are oriented axially with respect to the axis of rotation 5 of the blower wheel 2. The blower wheel fan blades 7 may be for example forward-curved fan blades, backward-curved fan blades or straight radial fan blades. The fan blades 7 are constructed to generate an airflow, which flows axially into the blower wheel 2 and radially out of the blower wheel 2.

Furthermore, the centrifugal fan assembly 1 comprises a guiding vane device 3 including a second number of guiding vanes 8. The guiding vanes 8 of the guiding vane device 3 are generally orientated at an angle to the axis of rotation 5 of the blower wheel 2, and exemplarily may be oriented perpendicularly to the axis of rotation 5 of the blower wheel 2. The guiding vane device 3 is coupled to the blower wheel 2. In operation, the guiding vane device 3 rotates with the blower wheel 2. The guiding vane device 3 is configured to guide the airflow into the blower wheel 2 and the rotating speed of the airflow gradually increases as it goes down the straight portion of the guiding vanes 8. The guiding vanes device 3 gradually accelerates incoming non-rotating airflow to the rotating speed of the blower wheel 2. The guiding vanes 8 may comprise a curved leading edge 9 and a straight portion which extends to the bottom of the blower wheel 2.

Figure 2:
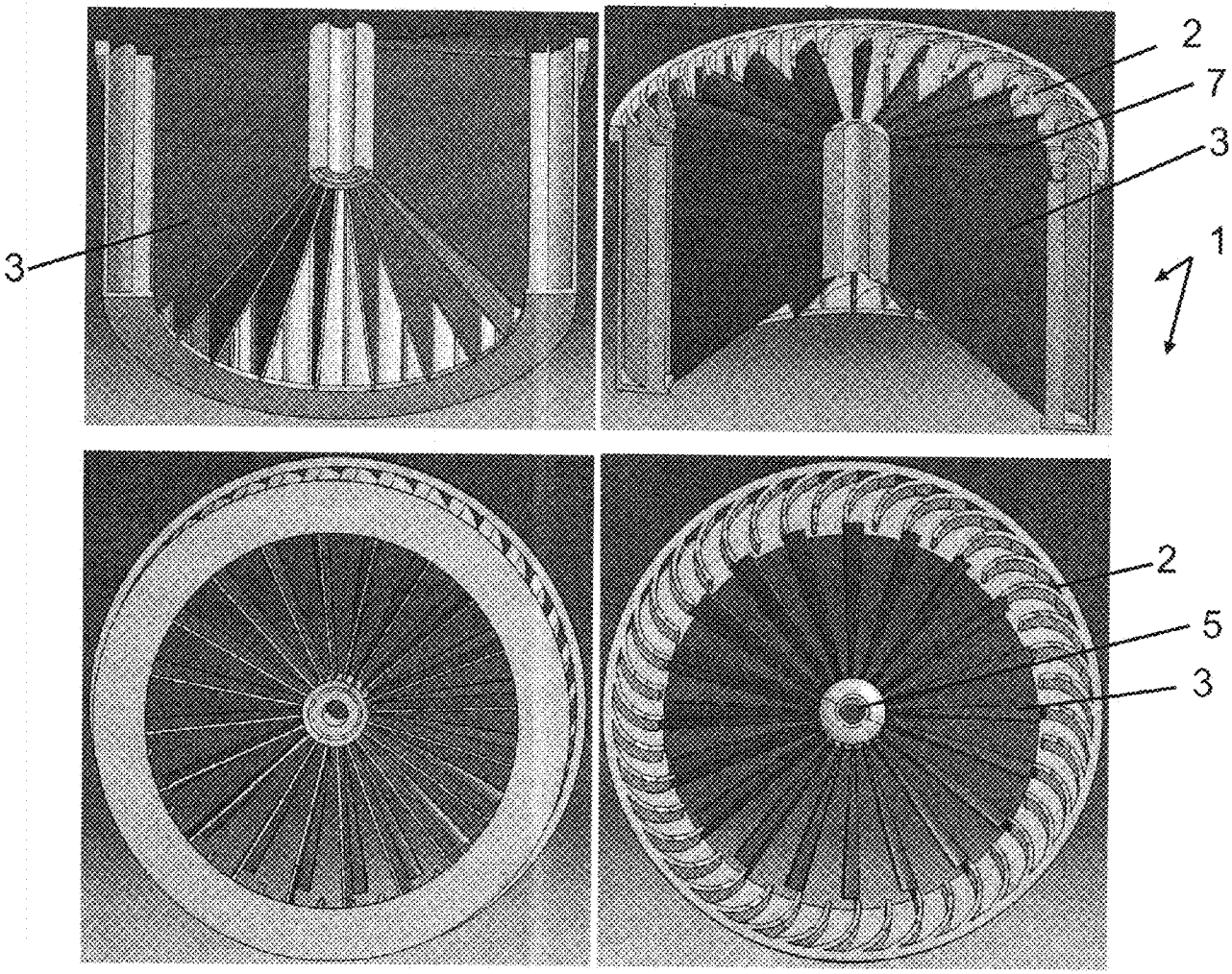
FIG. 2 illustrates different views of the centrifugal fan assembly.

FIG. 2 illustrates different views of the centrifugal fan assembly. The views on the top left and right side are perspective cross-section views of the blower wheel 2 and the guiding fan device 3. The views at the lower left and right side are perspective plan views of the blower wheel 2 and the guiding vane device 3 taken from the upper and lower side of the blower wheel 2. In this embodiment, the blower wheel and the guiding vane device are molded as one part.

Figure 3:
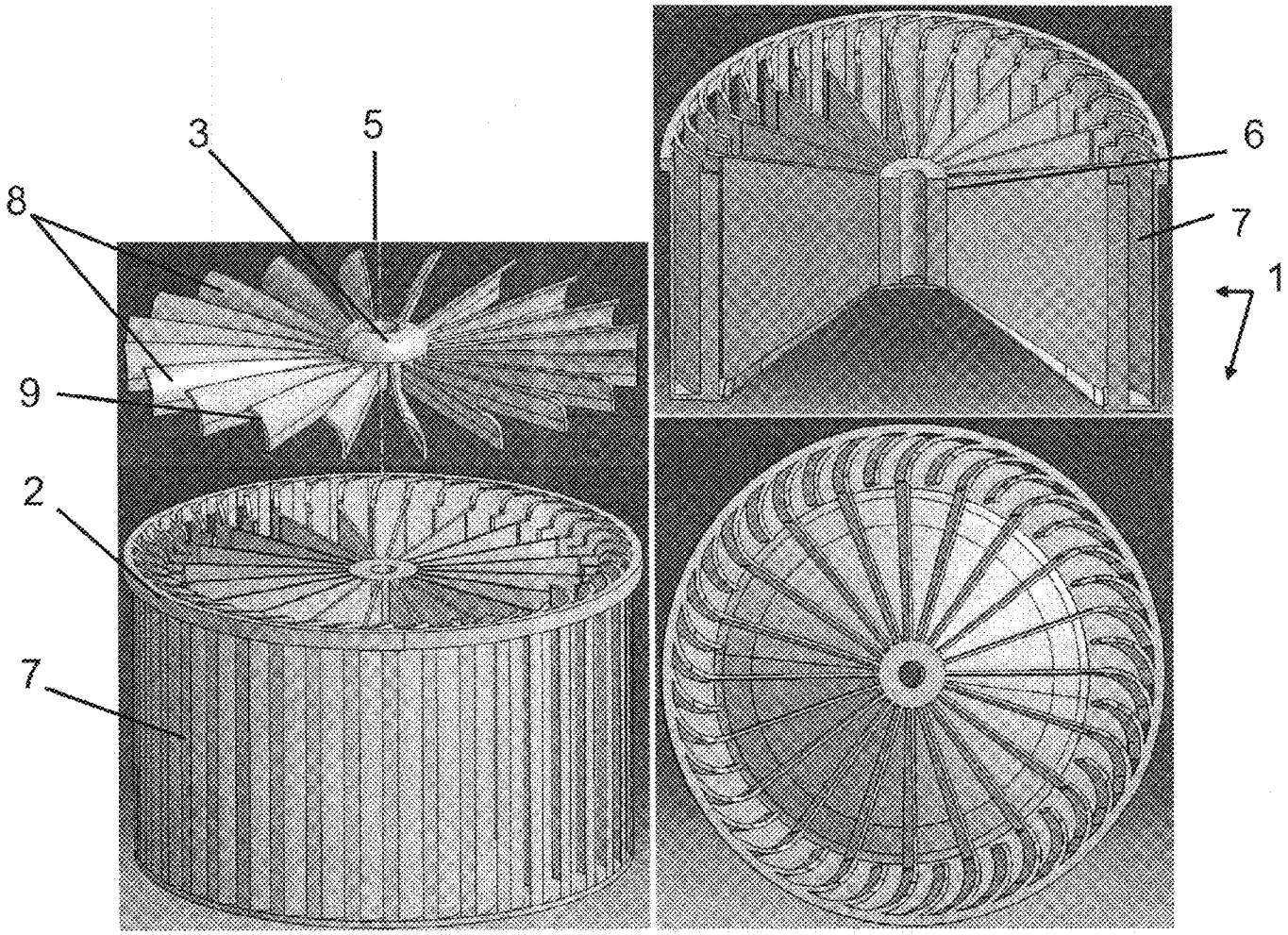
FIG. 3 illustrates different views of an embodiment of the centrifugal fan assembly according to the invention.

FIG. 3 illustrates different views of an embodiment of the centrifugal fan assembly according to the invention. On the left side is a perspective view of the blower wheel 2 and the guiding fan device 3. On the top right side is a perspective cross-section view of the blower wheel. The view at the lower right side is a plan view of the blower wheel taken from the top side.

In this embodiment the number of guiding vanes 8 is equal to half of the number of blower wheel fan blades 7.

Figure 4:
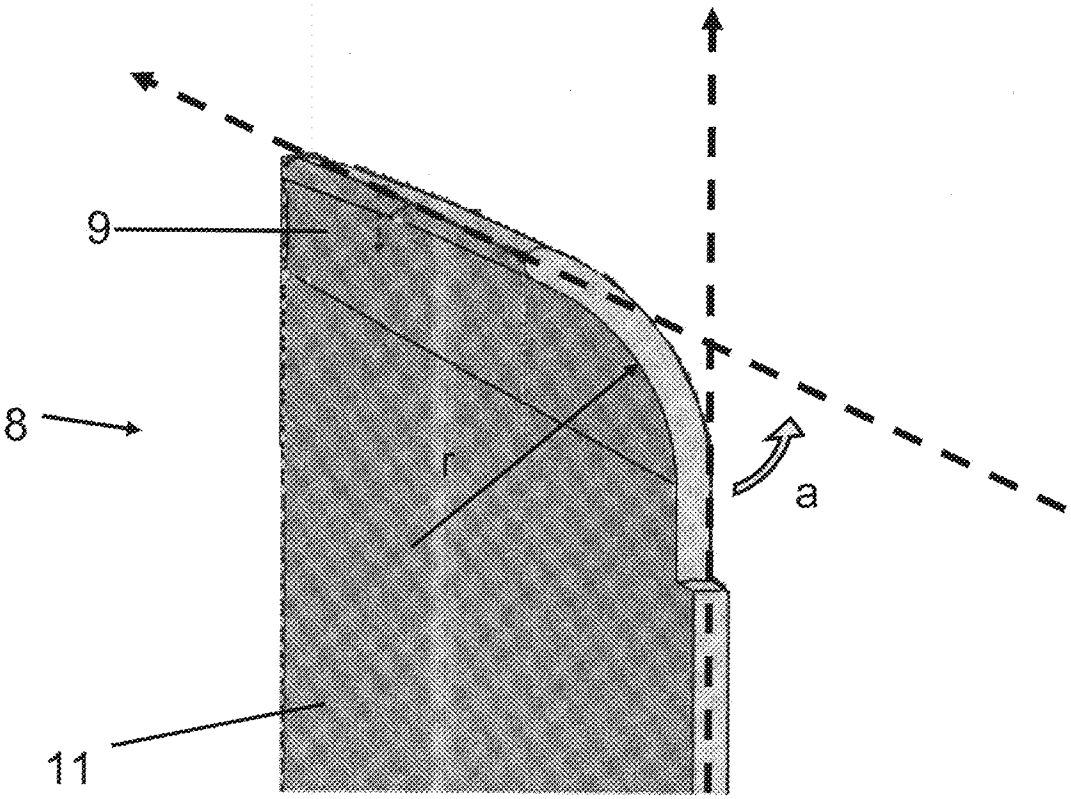
FIG. 4 is a perspective view of a guiding vane.

FIG. 4 is a perspective view of a guiding vane 8. The guiding vane 8 comprises a straight portion 11 and a curved leading edge portion 9. The angle between the straight portion 11 and the curved leading edge portion is set in a way that incoming airflow goes into guiding vane 8 in tangent direction (with an angle of attack of 0 degree). At different distances from the fan axis, this angle is determined by the arctangent local axial airflow velocity (that is calculated by dividing the flow rate by the cross sectional area at blower inlet) divided by local rotational velocity (maximum fan speed times $2\pi$ times distance from fan axis). The curved leading edge 9 that is shown in this embodiment has a circular arc. Other arc forms, such as a parabolic arc or a hyperbolic arc, are also contemplated in accordance with the present invention. The arc is used to gradually turn the incoming air flow to the axial direction of the blower wheel. The radius r of the arc should be large enough to ensure smooth turning of the flow without separation. The radius r of the arc should be as large as possible subject to design, and exemplarily may vary from the twentieth to the half of the entire length of a guiding vane 8. The radius r is exemplarily set in FIG. 4 at a quarter of the length of the guiding vane 8.

Figure 5:
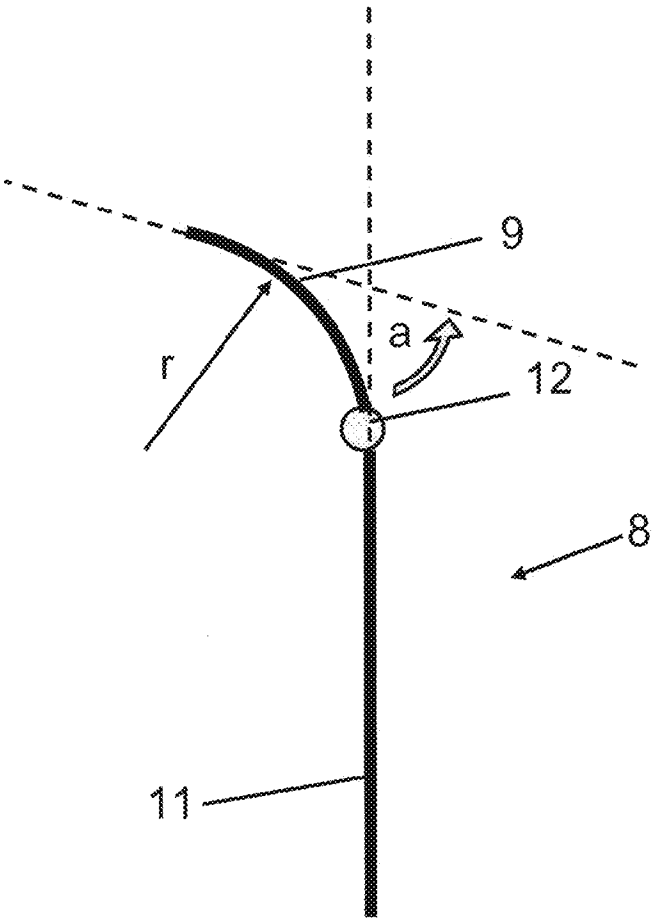
FIG. 5 is a perspective view of a guiding vane comprising a setting device.

FIG. 5 is a perspective view of a guiding vane 8 comprising a setting device 12. The guiding vane 8 comprises a straight portion 11 and a curved leading edge portion 9. Between the straight portion 11 and the curved leading edge portion 9 is arranged a setting device 12. The setting device 12 can be for example an electro-mechanical servomechanism. Of course, the setting device 12 can also be one of a piezo-actor, a hydraulic-actor and a pneumatic-actor. With the setting device 12 it is possible to adjust the angle a between the straight portion 11 and the curved leading edge portion 9 of the guiding vane 8 during operation of the centrifugal fan assembly. Therefore it is possible to optimize the performance of the centrifugal assembly at different rotational speeds of the guiding vane device 3 and the blower wheel 2.

Figure 6:
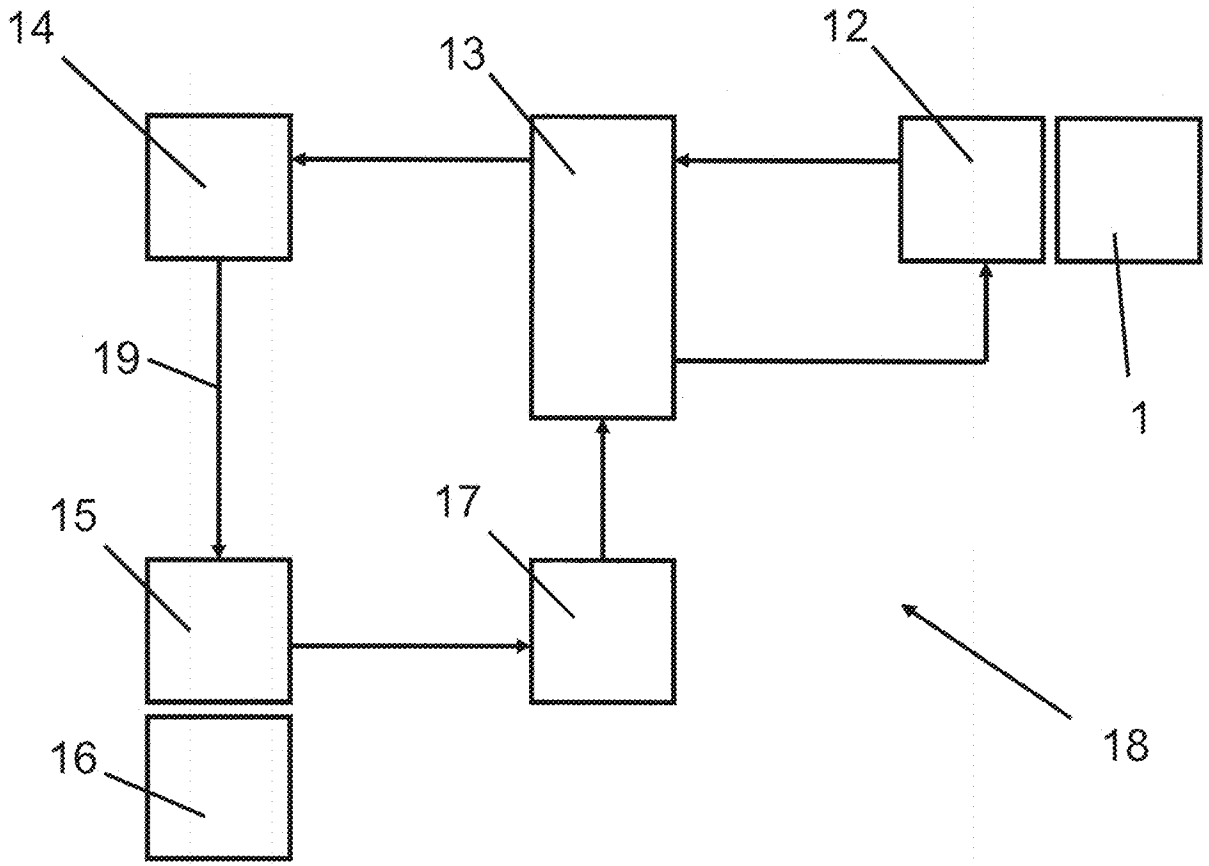
FIG. 6 is a schematic diagram of a HVAC-System according to invention.

FIG. 6 is a schematic diagram of a HVAC-System 18 (heating, ventilating and air conditioning system) according to invention. The HVAC-System 18 is used in an automotive vehicle. The HVAC-System comprising an evaporator 12, an expansion valve 13, a compressor 14, a condenser 15, a fan 16 and a centrifugal fan assembly 1 according to the invention. The centrifugal fan assembly 1 provides an airflow to the evaporator 12. However, the centrifugal fan assembly 1 can also be used to provide an airflow to the condenser 15.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

The invention claimed is:

1. A centrifugal fan assembly, comprising:

a housing, a blower wheel comprising a plurality of fan blades, wherein the blower wheel is rotatably mounted in the housing with respect to an axis of rotation and is constructed to generate an airflow flowing axially into the blower wheel and radially out from the blower wheel, and a guiding vane device including a plurality of guiding vanes, wherein a guiding vane comprises a straight portion and a curved leading edge portion, wherein the straight portion of the guiding vane extends radially entirely in a straight manner from the axis of rotation of the blower wheel, wherein an angle between the straight portion and the curved leading edge portion is set in a way that incoming airflow goes into the guiding vane in tangent direction, wherein at different distances from the axis of rotation, the angle is determined by the arctangent local axial airflow velocity divided by local rotational velocity, wherein the guiding vane device is coupled to the axis of rotation and is configured to guide the airflow into the blower wheel.

2. The centrifugal fan assembly of claim 1, wherein the guiding vane device is arranged at an axial end face of the blower wheel.

3. The centrifugal fan assembly of claim 1, wherein at least one of said plurality of guiding vanes comprises an actor, and wherein the angle of the curved leading edge is adjustable during operation by means of the actor.

4. The centrifugal fan assembly of claim 1, wherein the guiding vane device is formed integrally with the blower wheel, forming a single part.

5. The centrifugal fan assembly of claim 1, wherein the blower wheel comprises a plurality of fan blades that are one of forward-curved, backward-curved, and straight radial.

6. The centrifugal fan assembly of claim 1, wherein the blower wheel is driven by one of a direct drive, a belt drive, a magnetic coupling and a hydraulic coupling.

7. The centrifugal fan assembly of claim 1, wherein a number of said blades comprised by the plurality of fan blades differs from a number of said vanes comprised by the plurality of guiding vanes.

8. The centrifugal fan assembly of claim 1, wherein the number of said plurality of guiding vanes is equal to a half of the number of said plurality of fan blades.

9. The centrifugal fan assembly of claim 1, wherein the blower wheel is an injection molded plastic part.

10. The centrifugal fan of claim 1, wherein the guiding vane device is an injection molded plastic part.

11. An HVAC-System comprising:

a housing, a centrifugal fan, a blower wheel comprising a plurality of fan blades, wherein the blower wheel is rotatably mounted in the housing with respect to an axis of rotation and is constructed to generate an airflow flowing axially into the blower wheel and radially out from the blower wheel, and a guiding vane device including a plurality of guiding vanes, wherein a guiding vane comprises a straight portion and a curved leading edge portion, wherein the straight portion of the guiding vane extends radially entirely in a straight manner from the axis of rotation of the blower wheel, wherein an angle between the straight portion and the curved leading edge portion is set in a way that incoming airflow goes into the guiding vane in tangent direction, wherein at different distances from the axis of rotation, the angle is determined by arctangent local axial airflow velocity divided by local rotational velocity, wherein the guiding vane device is coupled to the axis of rotation and is configured to guide the airflow into the blower wheel.

12. A guiding vane device for a centrifugal fan assembly, the centrifugal fan assembly comprising a housing, a centrifugal fan, and a blower wheel comprising a plurality of fan blades, the guiding vane device comprising:

a plurality of guiding vanes, wherein a guiding vane comprises a straight portion and a curved leading edge portion, wherein the straight portion of the guiding vane extends radially entirely in a straight manner from the axis of rotation of the blower wheel, wherein an angle between the straight portion and the curved leading edge portion is set in a way that incoming airflow goes into the guiding vane in a tangent direction, wherein at different distances from the axis of rotation the angle is determined by arctangent local axial airflow velocity divided by local rotational velocity, wherein the guiding vane device is coupled to the axis of rotation and is configured to guide the airflow into the blower wheel.

* * * * *